US007897552B2

(12) United States Patent
Ellington et al.

(10) Patent No.: US 7,897,552 B2
(45) Date of Patent: Mar. 1, 2011

(54) ADDITIVES AND LUBRICANT FORMULATIONS FOR IMPROVED ANTIOXIDANT PROPERTIES

(75) Inventors: JoRuetta R. Ellington, Moseley, VA (US); John T. Loper, Richmond, VA (US); Naresh C. Mathur, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 697 days.

(21) Appl. No.: 11/947,897

(22) Filed: Nov. 30, 2007

(65) Prior Publication Data

US 2009/0143265 A1 Jun. 4, 2009

(51) Int. Cl.
*C10M 157/04* (2006.01)
*C10M 159/18* (2006.01)

(52) U.S. Cl. ..... 508/584; 508/362

(58) Field of Classification Search ..... 508/362, 508/584

See application file for complete search history.

(56) References Cited

U.S. PATENT DOCUMENTS

| | | | | |
|---|---|---|---|---|
| 2,160,273 | A | 5/1939 | Loane et al. | |
| 2,749,311 | A | 6/1956 | Sabol et al. | |
| 2,760,933 | A | 8/1956 | Fields et al. | |
| 2,765,289 | A | 10/1956 | Fields et al. | |
| 2,850,453 | A | 9/1958 | Fields | |
| 2,910,439 | A | 10/1959 | Fields | |
| 2,960,469 | A | 11/1960 | Young | |
| 3,047,503 | A | 7/1962 | Jaffe et al. | |
| 3,219,666 | A | 11/1965 | Norman et al. | |
| 3,357,948 | A * | 12/1967 | Stockmann et al. | 524/324 |
| 3,565,804 | A | 2/1971 | Honnen et al. | |
| 3,663,561 | A | 5/1972 | Blaha | |
| 3,697,574 | A | 10/1972 | Piasek et al. | |
| 3,736,357 | A | 5/1973 | Piasek et al. | |
| 3,794,081 | A | 2/1974 | Fiser et al. | |
| 3,840,549 | A | 10/1974 | Blaha et al. | |
| 4,028,342 | A | 6/1977 | Dale et al. | |
| 4,029,587 | A | 6/1977 | Koch | |
| 4,164,473 | A | 8/1979 | Coupland et al. | |
| 4,234,435 | A | 11/1980 | Meinhardt et al. | |
| 4,259,195 | A | 3/1981 | King et al. | |
| 4,261,843 | A | 4/1981 | King et al. | |
| 4,266,945 | A | 5/1981 | Karn | |
| 4,636,322 | A | 1/1987 | Nalesnik | |
| 4,692,256 | A | 9/1987 | Umemura et al. | |
| 4,889,647 | A | 12/1989 | Rowan et al. | |
| 4,904,401 | A | 2/1990 | Ripple et al. | |
| 4,957,649 | A | 9/1990 | Ripple et al. | |
| 5,137,647 | A | 8/1992 | Karol | |
| 5,287,731 | A | 2/1994 | Florkowski et al. | |
| 5,401,661 | A | 3/1995 | Florkowski et al. | |
| 5,412,130 | A | 5/1995 | Karol | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,744,430 | A | 4/1998 | Inoue et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,936,041 | A | 8/1999 | Diana et al. | |
| 6,074,444 | A | 6/2000 | Bingley | |
| 6,114,288 | A | 9/2000 | Fujitsu et al. | |
| 6,448,208 | B1 | 9/2002 | Dubs et al. | |
| 6,482,778 | B2 | 11/2002 | Tersigni et al. | |
| 6,509,303 | B1 | 1/2003 | Gatto | |
| 6,528,463 | B1 | 3/2003 | Gatto et al. | |
| 6,534,454 | B1 * | 3/2003 | Garmier et al. | 508/491 |
| 6,800,596 | B1 | 10/2004 | Loper | |
| 7,026,438 | B2 | 4/2006 | Camenzind et al. | |
| 2002/0019320 | A1 * | 2/2002 | Nakazato et al. | 508/159 |
| 2006/0040833 | A1 | 2/2006 | Al-Akhdar et al. | |
| 2006/0111257 | A1 * | 5/2006 | Kadkhodayan et al. | 508/585 |
| 2006/0128574 | A1 * | 6/2006 | Dong et al. | 508/557 |
| 2006/0223724 | A1 | 10/2006 | Gatto et al. | |

FOREIGN PATENT DOCUMENTS

| | | | |
|---|---|---|---|
| EP | 330522 | B1 | 8/1989 |
| WO | 0025731 | A1 | 5/2000 |
| WO | 2007115042 | A2 | 10/2007 |

OTHER PUBLICATIONS

Degussa, "Ralox LC Antioxidant for Latex, Rubber and Plastics," Internet web pages, 2004.

* cited by examiner

*Primary Examiner* — Glenn A Caldarola

(74) *Attorney, Agent, or Firm* — Luedeka, Neely & Graham, P.C.

(57) ABSTRACT

A lubricating oil composition, additive concentrate, method of lubricating moving parts, a method of improving the oxidation stability of a lubricant formulation. The lubricating oil composition includes a base oil, a hydrocarbon soluble molybdenum compound, and an antioxidant effective amount of one or more polymeric compounds devoid of ester linkages. The polymeric compound may be represented by of the formula:

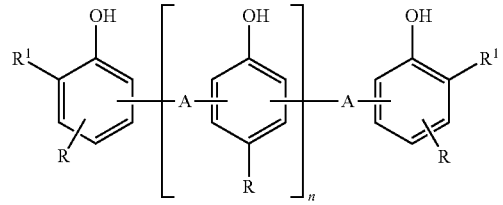

wherein R and $R^1$ are independently selected from $C_1$ to $C_{12}$ hydrocarbyl groups, n is an integer ranging from about 0 to about 10; and A is a hydrocarbyl group having from about 1 to about 30 carbon atoms.

19 Claims, No Drawings

ADDITIVES AND LUBRICANT FORMULATIONS FOR IMPROVED ANTIOXIDANT PROPERTIES

TECHNICAL FIELD

The embodiments described herein relate to lubricant additives and use of such additives in lubricating oil formulations, and in particular to additive formulations used to improve anti-oxidation properties of lubricant formulations.

BACKGROUND AND SUMMARY

Lubricating oils used in passenger cars and heavy duty diesel engines have changed over the years. Today's engines are designed to run hotter and harder than in the past. However, an adverse affect of running hotter is that oxidation of the oils increases as the operating temperature of the oil increases. Oxidation of the oils may lead to a viscosity increase in the oil and the formation of high temperature deposits caused by agglomerated oxidation by-products baking onto lubricated surfaces. Accordingly, certain phosphorus and sulfur additives have been used to reduce engine oil oxidation.

However, the next generation of passenger car motor oil and heavy duty diesel engine oil categories may require the presence of lower levels of phosphorus and sulfur containing antioxidant additives in the formulations in order to reduce contamination of more stringent pollution control devices. It is well known that sulfur and phosphorus containing additives may poison or otherwise reduce the effectiveness of pollution control devices.

With regard to the above, a need exists for a lubricating additive that provides excellent antioxidant properties and is more compatible with pollution control devices used for automotive and diesel engines. Such additives may contain phosphorus and sulfur or may be substantially devoid of phosphorus and sulfur.

In one embodiment herein is presented a lubricant composition comprising a base oil, a hydrocarbon soluble molybdenum compound, and an antioxidant effective amount of one or more polymeric compounds devoid of ester linkages of the formula:

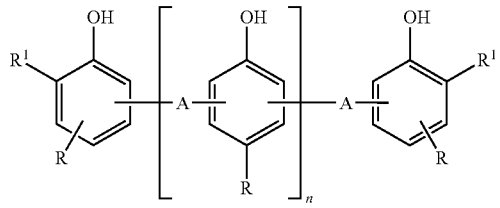

wherein R and $R^1$ are independently selected from $C_1$ to $C_{12}$ hydrocarbyl groups; n is an integer ranging from about 0 to about 10; and A is a hydrocarbyl group having from about 1 to about 30 carbon atoms.

In another embodiment, there is provided an additive concentrate for a lubricant composition. The concentrate includes an organomolybdenum friction modifier and an antioxidant effective amount of one or more polymeric compounds devoid of ester linkages of the formula:

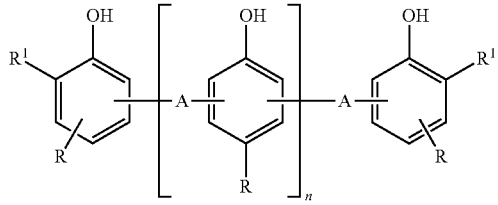

wherein R and $R^1$ are independently selected from $C_1$ to $C_{12}$ hydrocarbyl groups; n is an integer ranging from about 0 to about 10; and A is a hydrocarbyl group having from about 1 to about 30 carbon atoms and is selected from the group consisting of:

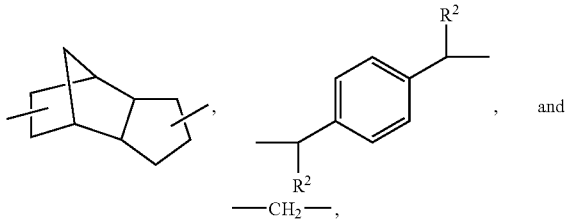

wherein $R^2$ is selected from the group consisting of $C_1$ to $C_4$ alkyl groups.

A further embodiment of the disclosure provides a method of reducing oxidation of engine lubricant compositions during operation of an engine containing the lubricant composition. The method includes contacting one or more engine parts with a lubricant composition comprising an oil of lubricating viscosity, an organomolybdenum friction modifier, and an antioxidant effective amount of one or more polymeric compounds devoid of ester linkages of the formula:

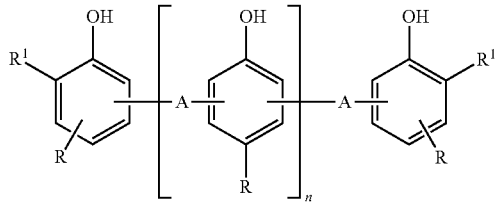

wherein R and $R^1$ are independently selected from $C_1$ to $C_{12}$ hydrocarbyl groups; n is an integer ranging from about 0 to about 10; and A is a hydrocarbyl group having from about 1 to about 30 carbon atoms and is selected from the group consisting of:

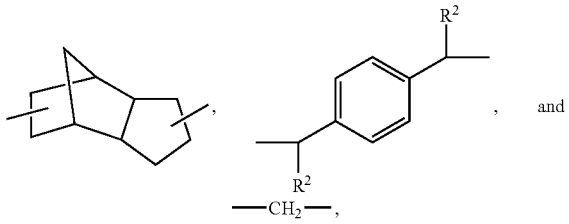

wherein $R^2$ is selected from the group consisting of $C_1$ to $C_4$ alkyl groups. The method further includes operating the engine containing the composition.

As set forth briefly above, embodiments of the disclosure provide an antioxidant additive composition that may significantly improve the oxidative stability of a lubricant composition and may enable a decrease in the amount of phosphorus and sulfur additives required for equivalent oxidative stability. The additive may be mixed with an oleaginous fluid that is applied to a surface between moving parts. In other applications, the additive may be provided in a fully formulated lubricant composition. The additive is particularly directed to meeting the current GF-4 and proposed GF-5 standards for passenger car motor oils and PC11 standards for heavy duty diesel engine oil as well as future passenger car and diesel engine oil specifications.

The compositions and methods described herein are particularly suitable for reducing contamination of pollution control devices on motor vehicles or, in the alternative, the compositions are suitable for improving the oxidative stability of lubricant formulations. Other features and advantages of the compositions and methods described herein may be evident by reference to the following detailed description which is intended to exemplify aspects of the preferred embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION OF EMBODIMENTS

In one embodiment of the present disclosure is presented a novel composition useful as an additive component in lubricating oil compositions. The composition may comprise a hydrocarbon soluble molybdenum compound and an antioxidant effective amount of one or more polymeric compounds devoid of ester linkages.

As used herein, the term "hydrocarbon soluble" means that the compound is substantially suspended or dissolved in a hydrocarbon material, as by reaction or complexation of a reactive metal compound with a hydrocarbon material. As used herein, "hydrocarbon" means any of a vast number of compounds containing carbon, hydrogen, and/or oxygen in various combinations.

The term "hydrocarbyl" refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Molybdenum Compound

A suitable organomolybdenum compound, also referred to as a hydrocarbon-soluble molybdenum compound, that may be used in embodiments of the present disclosure may include a sulfur-free molybdenum compound. Such a compound may be prepared by reacting a molybdenum source devoid of sulfur with an organic compound containing amino and/or alcohol groups. Examples of sulfur-free molybdenum sources may include molybdenum trioxide, ammonium molybdate, sodium molybdate, and potassium molybdate. The amino groups may be monoamines, diamines, or polyamines. The alcohol groups may be mono-substituted alcohols, diols or bis-alcohols, or polyalcohols. As an example, the reaction of diamines with fatty oils produces a product containing both amino and alcohol groups that can react with the sulfur-free molybdenum source.

It is believed that the organomolybdenum compound may act as a friction modifier in the lubricant composition. It is also believed that the presence of the organomolybdenum compound in the lubricant may augment the antioxidant properties of the polymeric component described below.

Examples of sulfur-free organomolybdenum compounds include the following:

1. Compounds prepared by reacting certain basic nitrogen compounds with a molybdenum source as described in U.S. Pat. Nos. 4,259,195 and 4,261,843.

2. Compounds prepared by reacting a hydrocarbyl substituted hydroxy alkylated amine with a molybdenum source as described in U.S. Pat. No. 4,164,473.

3. Compounds prepared by reacting a phenol aldehyde condensation product, a mono-alkylated alkylene diamine, and a molybdenum source as described in U.S. Pat. No. 4,266,945.

4. Compounds prepared by reacting a fatty oil, diethanolamine, and a molybdenum source as described in U.S. Pat. No. 4,889,647.

5. Compounds prepared by reacting a fatty oil or acid with 2-(2-aminoethyl)aminoethanol, and a molybdenum source as described in U.S. Pat. No. 5,137,647.

6. Compounds prepared by reacting a secondary amine with a molybdenum source as described in U.S. Pat. No. 4,692,256.

7. Compounds prepared by reacting a diol, diamino, or amino-alcohol compound with a molybdenum source as described in U.S. Pat. No. 5,412,130.

8. Compounds prepared by reacting a fatty oil, mono-alkylated alkylene diamine, and a molybdenum source as described in U.S. Pat. No. 6,509,303.

9. Compounds prepared by reacting a fatty acid, mono-alkylated alkylene diamine, glycerides, and a molybdenum source as described in U.S. Pat. No. 6,528,463.

Suitable molybdenum compounds prepared by reacting a fatty oil, diethanolamine, and a molybdenum source as described in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

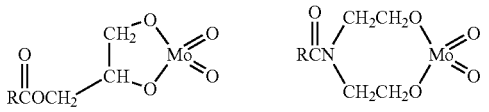

An example of a suitable molybdenum compound may be a compound available from R. T. Vanderbilt Company, Inc. of Norwalk, Conn. under the trade name MOLYVAN 855.

In embodiments of the present disclosure, the hydrocarbon-soluble molybdenum compound may be incorporated into the lubricating composition in an amount ranging from about 0.01 to about 0.5% by weight of the fully formulated lubricant composition. As a further example, the hydrocarbon-soluble molybdenum compound may be incorporated into the lubricating composition in an amount ranging from about 0.05 to about 0.35% by weight of the fully formulated lubricant composition. As a still further example, the hydrocarbon-soluble molybdenum compound may be incorporated into the lubricating composition in an amount ranging from about 0.05 to about 0.2% by weight of the fully formulated lubricant composition.

The hydrocarbon-soluble molybdenum compound may also be included in a lubricant additive concentrate. In such a concentrate, a suitable amount of the molybdenum compound may range from about 0.1 to about 5.0% by weight of the additive concentrate. As a further example, the molybdenum compound may range from about 0.5 to about 3.5% by weight of the additive concentrate. As another suitable example, the molybdenum compound may range from about 0.5 to about 2.0% by weight of the additive concentrate.

Polymeric Compound

Embodiments of the present disclosure may also include one or more polymeric compounds devoid of ester linkages of the formula:

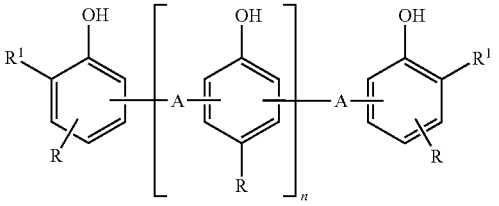

wherein R and $R^1$ are independently selected from $C_1$ to $C_{12}$ hydrocarbyl groups; n is an integer ranging from about 0 to about 10; and A is a hydrocarbyl group having from about 1 to about 30 carbon atoms and is selected from the group consisting of:

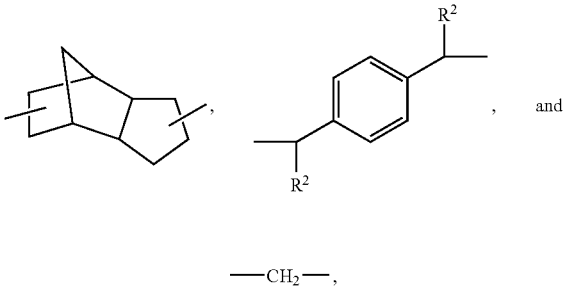

wherein $R^2$ is selected from the group consisting of $C_1$ to $C_4$ alkyl groups. An example of a suitable polymeric compound may be a compound having the following structural formula:

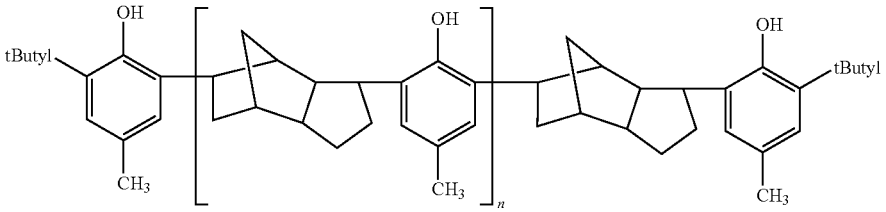

where n may range from 0 to 10.

In embodiments of the present disclosure, the polymeric compound may be used in an amount ranging from about 0.01 to about 1.0% by weight of the fully formulated lubricant. As another example, the polymeric compound may be used in an amount ranging from about 0.01 to about 0.75% by weight of the fully formulated lubricant. As a further example, the polymeric compound may be used in an amount ranging from about 0.01 to about 0.5% by weight of the fully formulated lubricant.

The polymeric compound may also be included as part of a lubricant additive concentrate. In such an additive composition, a suitable amount of the polymeric compound may range from about 0.1 to about 10.0% by weight of the additive concentrate. As another example, the polymeric compound may range from about 0.1 to about 7.5% by weight of the additive concentrate. As a further example, the polymeric compound may range from about 0.1 to about 5.0% by weight of the additive concentrate.

It is believed that a synergistic mixture of the above mentioned molybdenum compound and the above mentioned polymeric component may provide improved oxidation properties when formulated into lubricant or lubricant additive compositions.

Base Oils

Embodiments of the present disclosure may also include one or more base oils of lubricating viscosity. Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The base oil typically has a viscosity of about 2.5 to about 15 cSt and preferably about 2.5 to about 11 cSt at 100° C.

Accordingly, a lubricant composition of the present disclosure, comprising a molybdenum compound and a polymeric compound, as described above, may be suitable for use as a lubricant in a motor vehicle having moving parts. The moving parts may be the moving parts of an engine. The engine may be a spark ignition operating with biofuels, direct gasoline injection, variable valve timing, turbocharging, and after-treatment or a compression ignition engine operating with biofuels, turbocharging, cooled exhaust gas recirculation (EGR), after-treatment (including diesel particulate filters and selective catalytic reduction. The engine may comprise a crankcase, and the lubricant may comprise a crankcase oil present in the crankcase of the engine. In another embodiment, the lubricant may be a drive train lubricant present in a drive train of a vehicle containing the engine.

In an alternative embodiment of the present disclosure, the molybdenum compound and the polymeric compound may be formulated into a lubricant additive concentrate, suitable for addition to a base oil to make a fully formulated lubricant composition having improved antioxidant properties. The additive concentrate may further include other additives as described below.

In one embodiment of the present disclosure, a method of lubricating moving parts with a lubricating oil exhibiting increased antioxidant properties is contemplated. The method may include using as the lubricating for one or more moving parts a lubricant composition comprising an oil of lubricating viscosity, an organomolybdenum compound, and a polymeric compound as described above. The moving parts may be the moving parts of an engine or drive train as described above.

Another embodiment of the present disclosure provides a method of reducing oxidation of engine lubricant compositions during operation of an engine containing the lubricant composition. The method may include contacting one or more engine parts with a fully formulated lubricant composition as described herein. The engine may be a spark ignition or a compression ignition engine as described above. The engine may comprise a crankcase, and the lubricant may comprise a crankcase oil present in the crankcase of the engine. In one embodiment, the engine may be a heavy duty diesel engine.

In addition to the aforementioned molybdenum and polymeric components, embodiments of the present disclosure may further include one or more optional additive components, including, but not limited to, dispersants, antiwear agents, detergents, corrosion inhibitors, hydrocarbon-soluble titanium compounds, friction modifiers, pour point depressants, antifoam agents, viscosity index improvers, and mixtures of two or more of the foregoing.

Dispersant Components

Suitable dispersants may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729. In one embodiment of the present disclosure, the dispersant may be a polyisobutyl-succinic anhydride dispersant.

Antiwear Agents

The antiwear agents may include phosphorus-containing antiwear agents which may include an organic ester of phosphoric acid, phosphorous acid, or an amine salt thereof. For example, the phosphorus-containing antiwear agent may include one or more of a dihydrocarbyl phosphite, a trihydrocarbyl phosphite, a dihydrocarbyl phosphate, a trihydrocarbyl phosphate, any sulfur analogs thereof, and any amine salts thereof. As a further example, the phosphorus-containing antiwear agent may include at least one of dibutyl hydrogen phosphite and an amine salt of sulfurized dibutyl hydrogen phosphite.

The phosphorus-containing antiwear agent may be present in an amount sufficient to provide about 50 to about 1000 parts per million by weight of phosphorus in the fully formulated lubricant. As a further example, the phosphorus-containing antiwear agent may be present in an amount sufficient to provide about 150 to about 300 parts per million by weight of phosphorus in the fully formulated lubricant.

The lubricating fluid may include from about 0.01 wt % to about 1.0 wt % of the phosphorus-containing antiwear agent. As a further example, the lubricating fluid may include from about 0.2 wt % to about 1.0 wt % of the phosphorus-containing antiwear agent. As an example, the lubricating fluid may include from about 0.1 wt % to about 0.5 wt % of a dibutyl hydrogen phosphite or 0.3 wt % to about 0.5 wt % an amine salt of a sulfurized dibutyl hydrogen phosphate.

Zinc dialkyl dithiophosphates ("Zn DDPs") may also be used as antiwear agents in lubricating oils. Zn DDPs have good antiwear and antioxidant properties and have been used to pass cam wear tests, such as the Seq. IVA and TU3 Wear Test. Many patents address the manufacture and use of Zn DDPs including U.S. Pat. Nos. 4,904,401; 4,957,649; and 6,114,288. Non-limiting general Zn DDP types are primary, secondary and mixtures of primary and secondary Zn DDPs.

Metallic Detergents

Certain metallic detergents may optionally be included in the additive package and transmission fluids of the present invention. A suitable metallic detergent may include an oil-soluble neutral or overbased salt of alkali or alkaline earth metal with one or more of the following acidic substances (or mixtures thereof): (1) a sulfonic acid, (2) a carboxylic acid, (3) a salicylic acid, (4) an alkyl phenol, (5) a sulfurized alkyl phenol, and (6) an organic phosphorus acid characterized by at least one direct carbon-to-phosphorus linkage. Such an organic phosphorus acid may include those prepared by the treatment of an olefin polymer (e.g., polyisobutylene having a molecular weight of about 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

Suitable salts may include neutral or overbased salts of magnesium, calcium, or zinc. As a further example, suitable salts may include magnesium sulfonate, calcium sulfonate, zinc sulfonate, magnesium phenate, calcium phenate, and/or zinc phenate. See, e.g., U.S. Pat. No. 6,482,778.

Examples of suitable metal-containing detergents include, but are not limited to, neutral and overbased salts such as a sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a magnesium sulfonate, a magnesium carboxylate, a magnesium salicylate, a magnesium phenate, a sulfurized magnesium phenate, a calcium sulfonate, a calcium carboxylate, a calcium salicylate, a calcium phenate, a sulfurized calcium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate. Further examples include a lithium, sodium, potassium, calcium, and magnesium salt of a hydrolyzed phosphosulfurized olefin having about 10 to about 2,000 carbon atoms or of a hydrolyzed phosphosulfurized alcohol and/or an aliphatic-substituted phenolic compound having about 10 to about 2,000 carbon atoms. Even further examples include a lithium, sodium, potassium, calcium, and magnesium salt of an aliphatic carboxylic acid and an aliphatic substituted cycloaliphatic carboxylic acid and many other similar alkali and alkaline earth metal salts of oil-soluble organic acids. A mixture of a neutral or an overbased salt of two or more different alkali and/or alkaline earth metals can be used. Likewise, a neutral and/or an overbased salt of mixtures of two or more different acids can also be used.

While any effective amount of the metallic detergents may be used to enhance the benefits of this invention, typically these effective amounts will range from about 0.01 to about 2.0 wt. % in the finished fluid, or as a further example, from about 0.1 to about 1.5 wt. % in the finished fluid.

Friction Modifier Components

In addition to the aforementioned hydrocarbon soluble molybdenum compounds, compositions of the present disclosure may include additions friction modifiers. Glycerides may be used alone or in combination with other friction modifiers. Suitable glycerides may include glycerides of the formula:

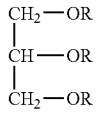

wherein each R is independently selected from the group consisting of H and C(O)R' where R' may be a saturated or an unsaturated alkyl group having from 3 to 23 carbon atoms. Examples of glycerides that may be used include glycerol monolaurate, glycerol monomyristate, glycerol monopalmitate, glycerol monostearate, and mono-glycerides derived from coconut acid, tallow acid, oleic acid, linoleic acid, and linolenic acids. Typical commercial monoglycerides contain substantial amounts of the corresponding diglycerides and triglycerides. These materials are not detrimental to the production of the molybdenum compounds, and may in fact be more active. Any ratio of mono- to di-glyceride may be used, however, it is preferred that from 30 to 70% of the available sites contain free hydroxyl groups (i.e., 30 to 70% of the total R groups of the glycerides represented by the above formula are hydrogen). A preferred glyceride is glycerol monooleate, which is generally a mixture of mono, di, and tri-glycerides derived from oleic acid, and glycerol. Suitable commercially-available glycerides include glycerol monooleates, which may generally contain approximately 50% to 60% free hydroxyl groups.

Corrosion Inhibitors

In some embodiments, copper corrosion inhibitors may constitute another class of additives suitable for inclusion in the compositions. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis (hydrocarbyldithio)-1,3,4-thiadiazoles. Suitable compounds include the 1,3,4-thiadiazoles, a number of which are available as articles of commerce, and also combinations of triazoles such as tolyltriazole with a 1,3,5-thiadiazole such as a 2,5-bis(alkyldithio)-1,3,4-thiadiazole. The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; and 3,840,549.

Rust or corrosion inhibitors are another type of inhibitor additive for use in embodiments of the present disclosure. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Another useful type of rust inhibitor may comprise alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of such rust or corrosion inhibitors can be used. The amount of corrosion inhibitor in the transmission fluid formulations described herein may range from about 0.01 to about 2.0 wt % based on the total weight of the formulation.

Demulsifiers

A small amount of a demulsifying component may be used. A preferred demulsifying component is described in EP 330,522. Such demulsifying component may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour Point Depressants

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates, polystyrene-succinate esters, and the like.

Viscosity Modifiers

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Antifoam Agents

Foam control may be provided by many compounds including an antifoamant of the polysiloxane type, for example, silicone oil or polydimethyl siloxane.

Seal Swell Agents

Seal swell agents, as described, for example, in U.S. Pat. Nos. 3,794,081 and 4,029,587, may also be used.

Hydrocarbon-Soluble Titanium Compounds

Examples of suitable titanium-containing compounds for use according to the disclosure, include, but are not limited titanium compounds derived from organic acids, amines, oxygenates, phenates, and sulfonates, such as titanium carboxylates, titanium phenates, titanium alkoxides, titanium aminic compounds, titanium sulfonates, titanium salicylates, titanium di-ketones, titanium crown ethers, and the like. Other than the sulfonates, such compounds may contain phosphorus and sulfur or may be substantially devoid of phosphorous and sulfur. The compounds may contain from about 3 to about 200 or more carbon atoms in a hydrocarbyl component of the compound. Examples of suitable titanium compounds may be found in U.S. Pat. Nos. 2,160,273; 2,960,469; and 6,074,444.

The hydrocarbon soluble compounds of the embodiments described herein are advantageously incorporated into lubricating compositions. Accordingly, the hydrocarbon soluble compounds may be added directly to the lubricating oil composition. In one embodiment, however, hydrocarbon soluble compounds are diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form an additive concentrate. The additive concentrates usually contain from about 0% to about 99% by weight diluent oil.

In the preparation of lubricating oil formulations it is common practice to introduce the additive concentrates in the form of 1 to 99 wt. % active ingredient concentrates in hydrocarbon oil, e.g. mineral lubricating oil, or other suitable solvent. Among the types of additives included in the additive concentrate may be detergents, dispersants, antiwear agents, friction modifiers, seal swell agents, antioxidants, foam inhibitors, lubricity agents, rust inhibitors, corrosion inhibitors, demulsifiers, viscosity index improvers, and the like. Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

In another embodiment, the additive concentrates may be top treated into a fully formulated motor oil or finished lubricant. The purpose of an additive concentrates is to make the handling of the various materials less difficult and awkward as well as to facilitate solution or dispersion in the final blend.

Lubricant compositions made with the additives described above are used in a wide variety of applications. For compression ignition engines and spark ignition engines, it is preferred that the lubricant compositions meet or exceed the current GF-4 standards or the proposed GF-5 or next "S" category API standards. Lubricant compositions according to the foregoing GF-5 or next "S" category API standards include a base oil, the DI additive package, and/or a VI improver to provide a fully formulated lubricant. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, such as automobile and truck engines, marine and railroad diesel engines, and the like.

In some embodiments, the fully formulated lubricant composition may comprise from about 100 to about 900 ppm of phosphorus.

The additives are typically blended into the base oil in an amount that enables that additive to provide its desired function. Representative effective amounts of additives, when used in lubricant formulations, are listed in Table 1 below. All the values listed are stated as weight percent active ingredient. These values are provided merely as exemplary ranges, and are not intended to limit the embodiments in any way.

TABLE 1

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ash-free amine phosphate salt | 0.1-6.0 | 0.1-4.0 |
| Antifoaming agent | 0-5.0 | 0.001-0.15 |
| Titanium Compound | 0-5.0 | 0-2.0 |
| Supplemental antiwear agents | 0-1.0 | 0-0.8 |
| Pour point depressant | 0.01-5.0 | 0.01-1.5 |
| Viscosity modifier | 0.01-20.00 | 0.25-10.0 |
| Supplemental friction modifier | 0-2.0 | 0.1-1.0 |
| Base oil | Balance | Balance |
| Total | 100 | 100 |

The additives may be added directly to the lubricating oil composition. In one embodiment, however, they are diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate.

The following example is given for the purpose of exemplifying aspects of the embodiments and is not intended to limit the embodiments in any way.

EXAMPLE 1

Six test formulations were made. All of the formulations had an additive package comprising a dispersant, a detergent, and other conventional additives as described above, in addition to a base oil or process oil. The formulas varied with respect to amounts of molybdenum compound and antioxidant used, and were tested for oxidation stability.

The oxidation stability of lubricant oils test formulations A-F, as shown in Table 2, were evaluated using a TEOST MHT-4 test. The TEOST MHT-4 test is a standard lubricant industry test for the evaluation of the oxidation and carbonaceous deposit-forming characteristics of engine oils. The test is designed to simulate high temperature deposit formation in the piston ring belt area of modern engines. The test uses a patented instrument (U.S. Pat. No. 5,401,661 and U.S. Pat. No. 5,287,731; the substance of each patent is hereby incorporated by reference) with the MHT-4 protocol being a relatively new modification to the test. Details of the test operation and specific MHT-4 conditions have been published by Selby and Florkowski in a paper entitled, "The Development of the TEOST Protocol MHT as a Bench Test of Engine Oil Piston Deposit Tendency" presented at the 12$^{th}$ International Colloquium Technische Akademie Esslingen, Jan. 11-13, 2000, Wilfried J. Bartz editor. In general, the lower the milligrams of deposit, the better the additive. The results are shown in the following table.

TABLE 2

| 5W30 Base Lubricant Composition | | | | | | |
|---|---|---|---|---|---|---|
| Test Fluid: | A | B | C | D | E | F |
| Mo Compound | 0.00 | 0.20 | 0.20 | 0.00 | 0.20 | 0.00 |
| Polymeric AO | 0.50 | 0.00 | 0.50 | 0.00 | 0.00 | 0.00 |
| Non-Polymeric AO | 0.00 | 0.00 | 0.00 | 0.00 | 0.50 | 0.50 |
| Dispersant | 2.10 | 2.10 | 2.10 | 2.10 | 2.10 | 2.10 |
| Detergent | 1.20 | 1.20 | 1.20 | 1.20 | 1.20 | 1.20 |
| Core Additive Package | 92.00 | 92.00 | 92.00 | 92.00 | 92.00 | 92.00 |
| Process Oil | 4.20 | 4.50 | 4.00 | 4.70 | 4.00 | 4.20 |
| Total | 100.00 | 100.00 | 100.00 | 100.00 | 100.00 | 100.00 |
| TEOST, mg | 14.70 | 25.70 | 6.10 | 40.70 | 25.40 | 21.20 |

As seen in Table 2, test formula C, an embodiment of the present disclosure having both the hydrocarbon-soluble molybdenum compound and the polymeric antioxidant (AO), had only 6.1 mg of deposit, significantly better than in any of the other test formulas lacking the combination of components required by the present disclosure. Formula A, having a polymeric antioxidant as described herein, but not a molybdenum compound, resulted in 14.70 mg of deposit. Formula B, having a molybdenum compound, but not a polymeric antioxidant, resulted in 25.70 mg of deposit. A control formula, formula D, was also tested. Formula D had neither a molybdenum compound nor a polymeric antioxidant, and resulted in 40.70 mg of deposit.

For comparison purposes, test formulations E and F were prepared with a non-polymeric phenolic antioxidant and without the polymeric antioxidant, with formula E including a molybdenum compound. As seen in the table, formula E resulted in 25.40 mg of deposit, a similar performance to formula B that had the molybdenum compound but no additional antioxidant component. Similarly, formula F resulted in 21.20 mg of deposit. It is believed that the combination of molybdenum compound and polymeric antioxidant as described herein provided synergistic improvement in the oxidation stability of the lubricant formulation C as evidenced by the results in Table 2.

At numerous places throughout this specification, reference has been made to a number of U.S. patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricating oil composition, comprising a base oil, a hydrocarbon soluble molybdenum compound, and an amount of one or more polymeric compounds devoid of ester linkages of the formula:

formula (I)

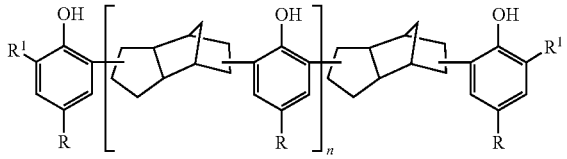

wherein R and R' are independently selected from $C_1$ to $C_{12}$ hydrocarbyl groups, and n is an integer ranging from 0 to 10, and wherein molybdenum compound is present in an amount ranging from about 0.01 to about 0.5 weight percent and the amount of the compound of formula (I) ranges from about 0.01 to about 1.0 weight percent based on a total weight of the lubricating oil composition.

2. The composition of claim 1, wherein the hydrocarbon soluble molybdenum compound comprises a molybdenum compound devoid of sulfur.

3. The composition of claim 1, wherein the hydrocarbon soluble molybdenum compound comprises a molybdenum amine complex.

4. The composition of claim 1, wherein the polymeric compound comprises

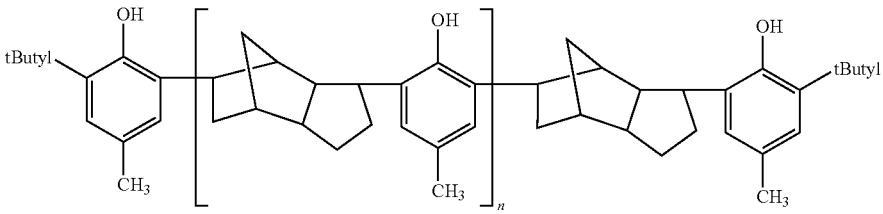

wherein n ranges from about 0 to about 10.

5. The composition of claim 1, further comprising a component selected from the group consisting of dispersants, antiwear agents, detergents, corrosion inhibitors, hydrocarbon-soluble titanium compounds, friction modifiers, pour point depressants, antifoam agents, extreme pressure agents, viscosity index improvers, and mixtures of two or more of the foregoing.

6. The composition of claim 1, wherein the composition comprises from about 100 to about 900 ppm phosphorus.

7. The composition of claim 1, wherein the composition comprises a crankcase lubricant for an engine selected from the group consisting of spark ignition engines and compression ignition engines.

8. An additive concentrate for a lubricating oil composition comprising a hydrocarbon soluble molybdenum compound, and an amount of one or more polymeric compounds devoid of ester linkages of the formula:

formula (I)

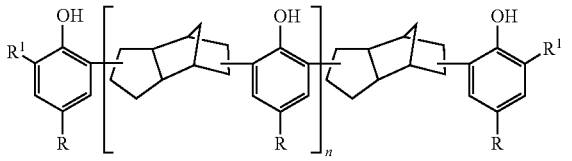

wherein R and $R^1$ are independently selected from $C_1$ to $C_{12}$ hydrocarbyl groups, n is an integer ranging from about 0 to about 10, and wherein molybdenum compound is present in an amount ranging from about 0.1 to about 5.0 weight percent and the amount of the compound of formula (I) ranges from about 0.1 to about 10.0 weight percent based on a total weight of the concentrate.

9. The additive concentrate of claim 8, wherein the polymeric compound comprises

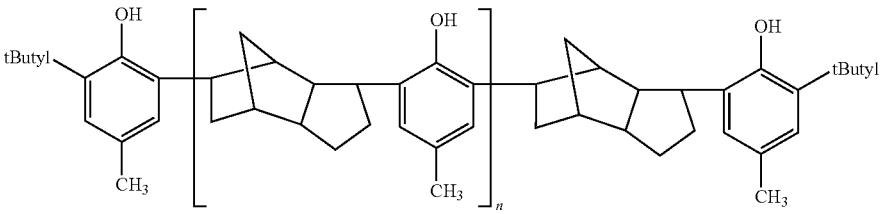

wherein n ranges from about 0 to about 10.

10. The additive concentrate of claim 8, wherein the hydrocarbon soluble molybdenum compound comprises a molybdenum compound devoid of sulfur.

11. The additive concentrate of claim 8, wherein the hydrocarbon soluble molybdenum compound comprises a molybdenum amine complex.

12. The additive concentrate of claim 8, further comprising a component selected from the group consisting of dispersants, antiwear agents, detergents, corrosion inhibitors, hydrocarbon-soluble titanium compounds, friction modifiers, pour point depressants, antifoam agents, extreme pressure agents, viscosity index improvers, and mixtures of two or more of the foregoing.

13. A method of reducing oxidation of engine lubricant compositions during operation of an engine containing the lubricant composition, comprising contacting one or more engine parts with a lubricant composition comprising an oil of lubricating viscosity, an organomolybdenum friction modifier, and an amount of one or more polymeric compounds devoid of ester linkages of the formula:

formula (I)

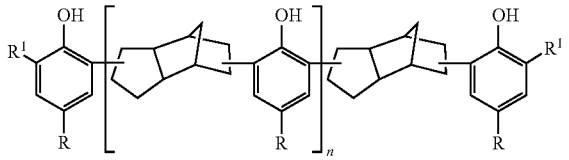

wherein R and $R^1$ are independently selected from $C_1$ to $C_{12}$ hydrocarbyl groups, n is an integer ranging from about 0 to about 10, and wherein molybdenum compound is present in an amount ranging from about 0.01 to about 0.5 weight percent and the amount of the compound of formula (I) ranges from about 0.01 to about 1.0 weight percent based on a total weight of the lubricating oil composition.

14. The method of claim 13, wherein the polymeric compound comprises

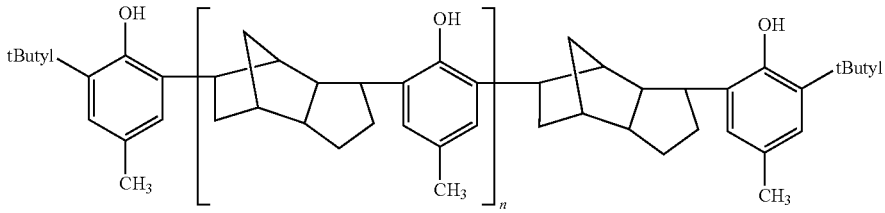

wherein n ranges from about 0 to about 10.

15. The method of claim 13, wherein the hydrocarbon soluble molybdenum compound comprises a molybdenum compound devoid of sulfur.

16. The method of claim 13, wherein the hydrocarbon soluble molybdenum compound comprises a molybdenum amine complex.

17. The method of claim 13, wherein the composition comprises from about 100 to about 900 ppm phosphorus.

18. The method of claim 13, wherein the lubricant composition comprises a crankcase lubricant for an engine selected from the group consisting of spark ignition engines and compression ignition engines.

19. The method of claim 18, wherein the engine comprises a heavy duty diesel engine.

* * * * *